US005858040A

United States Patent [19]

Hansen

[11] Patent Number: 5,858,040

[45] Date of Patent: Jan. 12, 1999

[54] FILLING MACHINE HAVING A MICROFILTRATED CLEAN AIR SUPPLY SYSTEM

[75] Inventor: David J. Hansen, St. Paul, Minn.

[73] Assignee: Tetra Laval Holdings & Finance, SA, Pully, Switzerland

[21] Appl. No.: 828,931

[22] Filed: Mar. 28, 1997

[51] Int. Cl.[6] ..... B65B 55/00

[52] U.S. Cl. ..... 55/385.2; 55/472; 55/485; 55/486; 55/487

[58] Field of Search ..... 55/472, 485, 486, 55/487, 385.2

[56] References Cited

U.S. PATENT DOCUMENTS

| | | | |
|---|---|---|---|
| 3,703,801 | 11/1972 | Deckas | 55/385.2 |
| 3,854,874 | 12/1974 | Loliger et al. . | |
| 4,249,244 | 2/1981 | Shofner et al. . | |
| 4,417,607 | 11/1983 | Scholle et al. . | |
| 4,566,251 | 1/1986 | Spisak et al. . | |
| 4,784,675 | 11/1988 | Leber et al. | 55/485 |
| 4,788,811 | 12/1988 | Kawajiri et al. . | |
| 4,803,827 | 2/1989 | Posey et al. . | |
| 4,938,309 | 7/1990 | Emdy | 96/382 |
| 4,944,132 | 7/1990 | Carlsson et al. . | |
| 4,964,444 | 10/1990 | Hanerus et al. . | |
| 4,992,247 | 2/1991 | Foti . | |
| 5,035,101 | 7/1991 | Wakabayashi et al. . | |
| 5,053,196 | 10/1991 | Ide et al. . | |
| 5,129,212 | 7/1992 | Duffey et al. . | |
| 5,152,968 | 10/1992 | Foti et al. . | |
| 5,282,151 | 1/1994 | Knollenberg . | |
| 5,288,298 | 2/1994 | Aston | 55/485 |
| 5,319,575 | 6/1994 | Lilienfeld . | |
| 5,406,772 | 4/1995 | Dinius . | |
| 5,488,811 | 2/1996 | Wang et al. . | |
| 5,534,222 | 7/1996 | Kelbrick et al. . | |
| 5,622,543 | 4/1997 | Yang | 55/485 |

*Primary Examiner*—Jay H. Woo
*Assistant Examiner*—Minh-Chau T. Pham
*Attorney, Agent, or Firm*—Michael A. Catania

[57] ABSTRACT

A microfiltrated clean air supply system for providing a highly filtered supply of clean air suitable for aseptic packaging (for example, class 100 or better) in a filling machine is provided. In an embodiment, the clean air supply system includes a housing having an inlet and an outlet. A first plurality of filters are arranged in order of increasing collection efficiency within the housing adjacent the inlet. Similarly a second plurality of filters are arranged within the housing near the outlet. The second plurality of filters are also arranged in order of increasing collection efficiency. The clean air supply system also includes a chamber located between the first plurality of filters and the second plurality of filters. The chamber includes a wall separating the chamber from the second plurality of filters. A blower is arranged in the chamber between the first and second plurality of filters. The blower has an exhaust port which is arranged in fluid communication with an aperture formed in the wall of the chamber. Thus, air is drawn in through the inlet of the housing and passes through the first plurality of filters. The air is drawn through the housing by the blower and expelled through the exhaust port into the second plurality of filters. The filtered air is then expelled through the outlet of the housing.

1 Claim, 7 Drawing Sheets

FILLING MACHINE HAVING A MICROFILTRATED CLEAN AIR SUPPLY SYSTEM

BACKGROUND OF THE INVENTION

The present invention relates to an apparatus for filling containers, and more particularly, to a microfiltrated clean air supply system for a filling machine. The microfiltrated clean air supply system provides high volume, substantially particle-free air flow to the filling machine. The clean air supply system uses sets of relatively less expensive filters to advantageously provide a clean air supply to the filling machine.

Current packaging machines integrate various components necessary to fill and seal a container into a single machine unit. Such a packaging machine is used to perform a packaging process, which generally stated, includes feeding carton blanks into the machine to form cartons, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine." The machine disclosed in that patent includes a plurality of processing stations, each station implementing one or more processes to form, fill, and seal the containers. Each of the processing stations is driven by one or more servomotors that drive the various components of each of the processing stations.

Another type of packaging machine is exemplified by the TR/7™ and TR/8™ packaging machines manufactured and available from Tetra Pak, Inc. Such machines are of a more conventional type in which many of the components are driven from a common drive motor through, for example, indexing gears and cam mechanisms.

Problems also occur in known filling machines having clean air supply systems. For example, certain machines have possible recontamination and recirculation problems as a result of not providing point of use delivery. Another problem is that known clean air systems do not provide the filters with adequate protection from product spills or other liquid splashes. Such known systems typically include blowers and HEPA filters located above the conveyor line of containers to be filled. Perforated metal diffuser plates are typically arranged beneath the filters. However, these systems do not provide adequate protection from product or other liquid splashes. Similarly, a related problem is that certain known clean air systems are not cleanable by automatic methods and equipment. As a result, the clean air systems can act as recontamination sites.

Currently, known filling and packaging machines utilize clean air systems having filters for cleaning the incoming ambient air to subsequently provide a clean air supply to the filling machine. Certain filling machines use what are known as "absolute" membrane-style filters. These filters are quite expensive, have utilities consumption costs, require substantial ancillary equipment including compressor pumps, and have relatively low throughput capacity. As a result of the high initial cost of these systems, as well as the maintenance costs, and utilities consumption costs, for a clean air supply system used on a filling machine or other apparatus is directly increased. A filtered air system in which less costly filters could be used, while still yielding a comparable collection efficiency is currently needed. In addition, a filtered air system having reduced utilities consumption costs and increased capacity is needed.

BRIEF SUMMARY OF THE INVENTION

A microfiltrated clean air supply system for providing a highly filtered supply of clean air in a filling machine is provided. Levels of filtration previously attainable only by using absolute membrane-style filters may be obtained using lower cost filters. To this end, an embodiment of the clean air supply system includes a housing having an inlet and an outlet. A first plurality of filters are arranged within the housing adjacent the inlet. In addition, the first plurality of filters is arranged in order of increasing collection efficiency. Similarly, a second plurality of filters is arranged within the housing near the outlet. The second plurality of filters is also arranged in order of increasing collection efficiency. The clean air supply system also includes a chamber located between the first and second plurality of filters. The chamber includes a wall separating the chamber from the second plurality of filters. A blower is arranged in the chamber between the first and second plurality of filters. The blower has an exhaust port which is arranged in fluid communication with an aperture formed in the wall of the chamber. Thus, air is drawn in through the inlet of the housing and passes through the first plurality of filters arranged in order of increasing collection efficiency. The air is then drawn through the housing by the blower, and a high volume of prefiltered air is expelled through the exhaust port into the second plurality of filters which are also arranged in order of increasing collection efficiency. The prefiltered air is thus blown through the second plurality of filters so that filtered air is expelled through the outlet of the housing into the filling machine.

An embodiment of the microfiltrated clean air supply system comprises a high capacity, single-pass system where "dirty" air is drawn in from the surrounding environment and converted via filtration, to high quality clean air potentially suitable for use in aseptic packaging applications (i.e., Class 100 or better). This level of air quality is accomplished, even in highly challenging environments, through the use of five different levels of filtration, including:

1) coalescing filters for condensed moisture removal;
2) roughing filters (for example 30%–60% ASHRAE) for the first stage of mold and aerosol mass removal; these filters are antimicrobially treated to inhibit mold growth.
3) 95% ASHRAE filters for the effective removal of mold and the majority of the mass concentration; these filters are antimicrobially treated to inhibit mold growth.
4) 95% DOP-rated filters for prefiltration of submicron particles (including bacteria); and
5) 99.99999% collection efficiency PSL-rated filters (at 0.12 $\mu$m) for the final filtration of remaining particulates.

In an embodiment, a high pressure, direct drive blower is provided. The flow rate of the blower can be varied from 0–2,000 cfm using a variable frequency driver (VFD).

An advantage of an embodiment of a microfiltrated clean air supply system is to provide a combined collection efficiency of greater than or equal to 99.9999995% for 0.3 $\mu$m particles which yields a penetration probability of less than or equal to $5\times10^{-9}$. Such a probability is comparable to the measurable filtration capability of an "absolute" membrane-style filter discussed above.

Another advantage of a filling machine having a microfiltrated clean air supply system is that it can be cleaned and sterilized by automatic methods and equipment. The arrangement of the microfiltrated clean air supply system and its components enables automatic cleaning methods and equipment to be used. To this end, an adjustable bypass damper mechanism is provided to isolate the clean air supply system from the filling machine. Similarly, the components of the clean air supply system are arranged to avoid interfering with the automatic cleaning equipment.

A related advantage of protecting the filters of the clean air supply system from contamination during a carton crash or a chemical splash is accomplished using the bypass damper mechanism. The damper can be closed to deflect liquid product and isolate the filters from contaminating spills. The damper is arranged between the inlet ducting of a sterile chamber in the filling machine and the filters of the clean air supply system.

It is a further advantage of a filling machine having a microfiltrated clean air supply system to provide a positive pressure air supply to the filling machine, for example, a variable, high capacity air handling capability on the order of 0–2,000 cfm to the filling machine.

DETAILED DESCRIPTION OF THE INVENTION

A filling machine having a microfiltrated clean air supply system to provide a filtered clean air supply to portions of the filling machine is provided. The microfiltrated clean air supply system has a modular arrangement to enable a plurality of relatively less expensive filters to be used for cleaning the air supplied to the filling machine.

Figure 1:
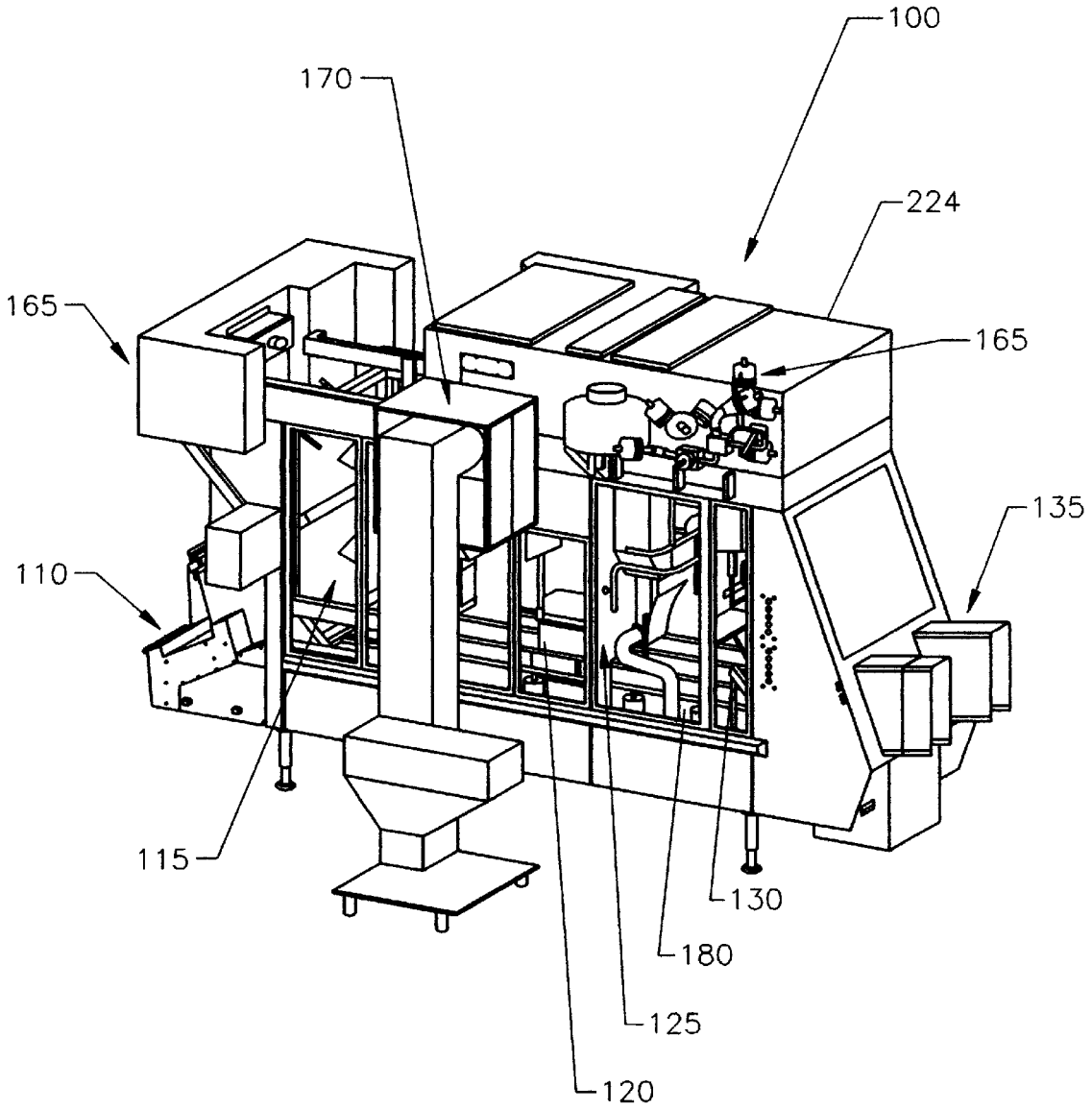
FIG. 1 is a perspective view of an embodiment of a filling machine incorporating a microfiltrated clean air supply system of the present invention.
Figure 2:
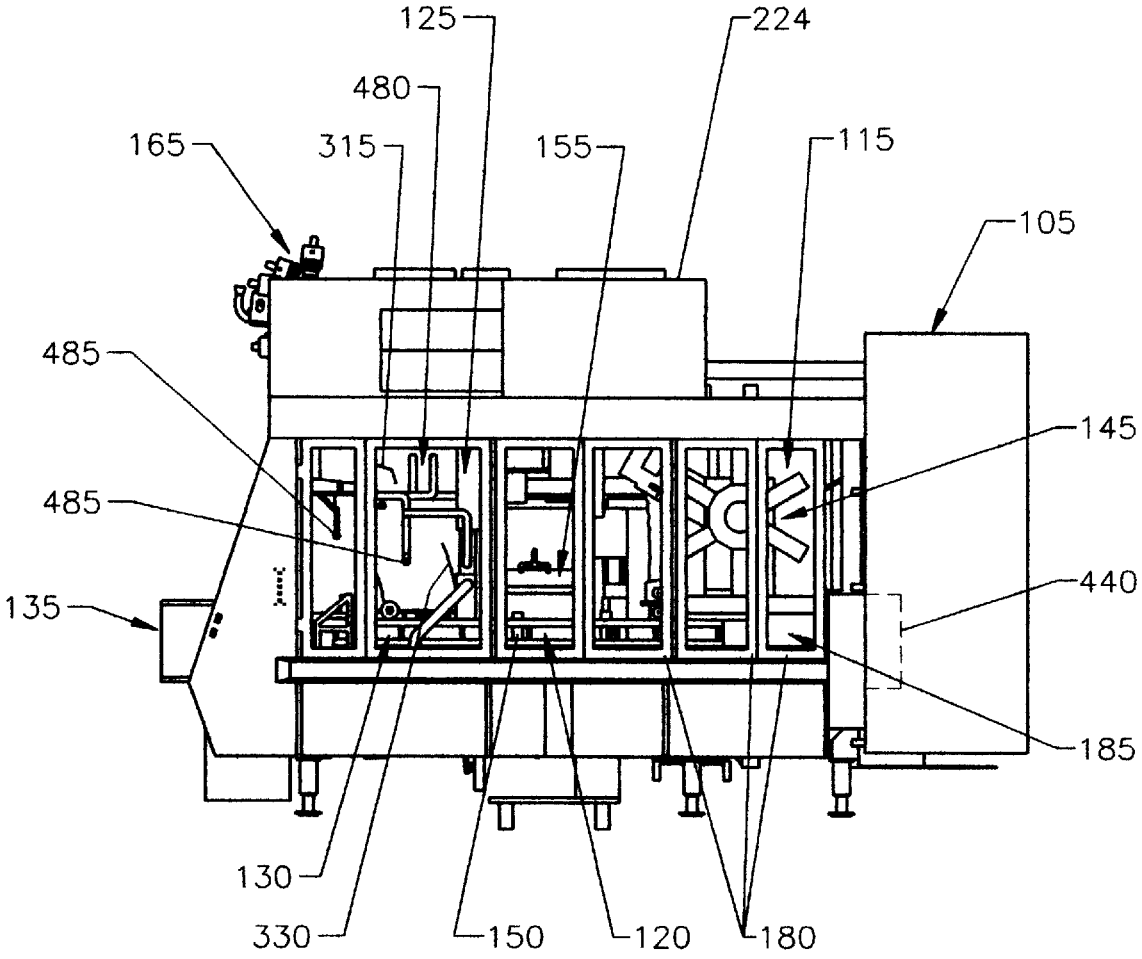
FIG. 2 is a side view of the embodiment of the filling machine of FIG. 1 incorporating the microfiltrated clean air supply system.
Figure 3:
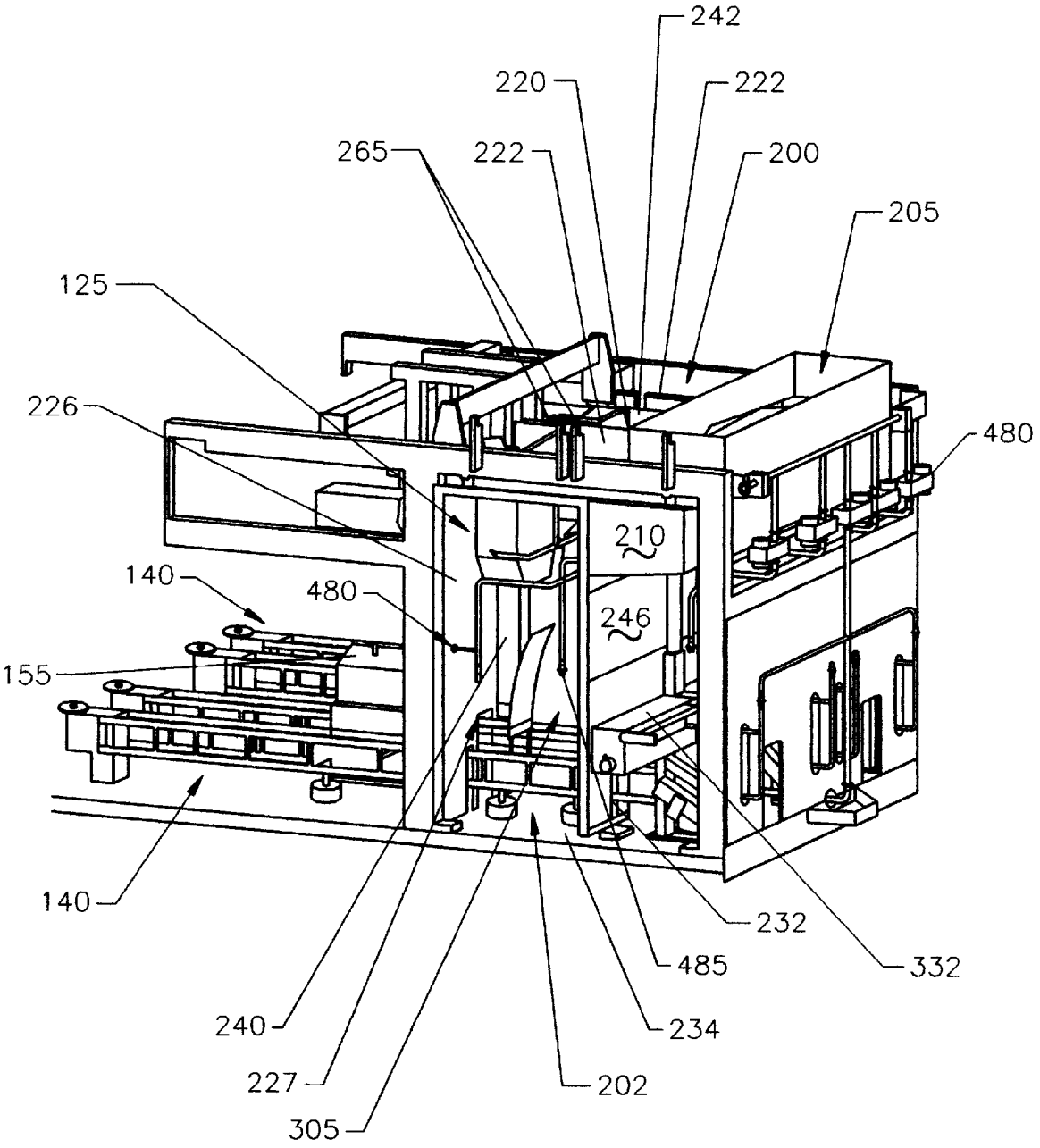
FIG. 3 is a perspective view of the embodiment of the filling machine of FIG. 1 with components removed illustrating the orientation of corresponding ductwork to operate with an embodiment of the microfiltrated clean air supply system.

As illustrated in FIGS. 1–3, the filling machine, shown generally at 100, comprises a plurality of machine stations. In the illustrated embodiment, the stations are arranged sequentially within the filling machine 100 as follows: a carton magazine station 110, a carton forming station 115, a sterilizing station 120, a carton filling station 125, a carton sealing station 130 and a carton off-loading station 135. The cartons, gable-top cartons in the illustrated example, are transported between the carton forming station 115, sterilizing station 120, carton filling station 125, carton sealing station 130, and carton off-loading station 135 by a conveyor system 140. The machine stations are, for example, under the control of a control unit that is disposed in a control cabinet 105. The control unit monitors and controls the operation of the filling machine 100. Although the illustrated system is a dual-line machine, it will be recognized that the machine 100 may be constructed as a single line machine as well.

In operation of the machine 100, a supply of carton blanks are arranged at the carton magazine station 110. Individual carton blanks are erected and subsequently removed from the carton magazine station 110 and placed on a mandrel 145 located in the carton forming station 115. While on the mandrel 145, the erected cartons are rotated between subsequent bottom-sealing stations to form a carton having an open top and a sealed bottom. The carton thus has an open top as it enters the sterilizing station 120. At the sterilizing station 120, the cartons are subject to a hydrogen peroxide spray followed by UV irradiation by an ultraviolet light assembly 155 to sterilize the interior of the carton prior to filling with product.

Each sterilized carton is transferred from the sterilizing station 120 to the carton filling station 125 where it is filled with product. The product is provided to close carton through a pump and a fill pipe which are connected to receive product from a balance or intermediate storage tank 160 through a valve cluster 165. One example of such a valve cluster 165 is described in U.S. Pat. No. 5,755,155, entitled Aseptic process Interface Group.

Once filled with product, each carton 150 is closed and sealed at the carton sealing station 130. The carton sealing station 130 comprises a top folder mechanism which, for example, uses a pair of opposed wheels to temporarily fold and close the top of the carton. The top sealing station 130 further comprises a top sealer, such as an ultrasonic sealer, that hermetically seals the top of the carton. An example of such a carton sealing station 130 is disclosed in a patent application entitled, "Top Folding and Sealing Apparatus For Forming and Sealing the Fin of a Gabled Carton," U.S. patent application Ser. No. 08/828,311. Other top sealing mechanisms are likewise suitable for use in the illustrated machine. After the carton is filled and sealed, it is transferred out of the filling machine 100 at the off-loading station 135.

FIG. 1 also illustrates an optional screw cap applicator station 170 that is optionally provided to apply a screw cap to each carton. The screw cap applicator station 170 may be constructed in accordance with any known system. It may also include a cap sterilizing station such as the one disclosed in a patent application entitled "Filling Machine Having a Screw Cap Sterilization Apparatus and Method of Operating Same," U.S. patent application Ser. No. 08/828,343. Further, the filling machine 100 includes a plurality of doors 180 arranged to enclose the various stations. The doors 180 preferably have transparent portions 185 to allow observation of the operation of the individual stations.

Figure 4:
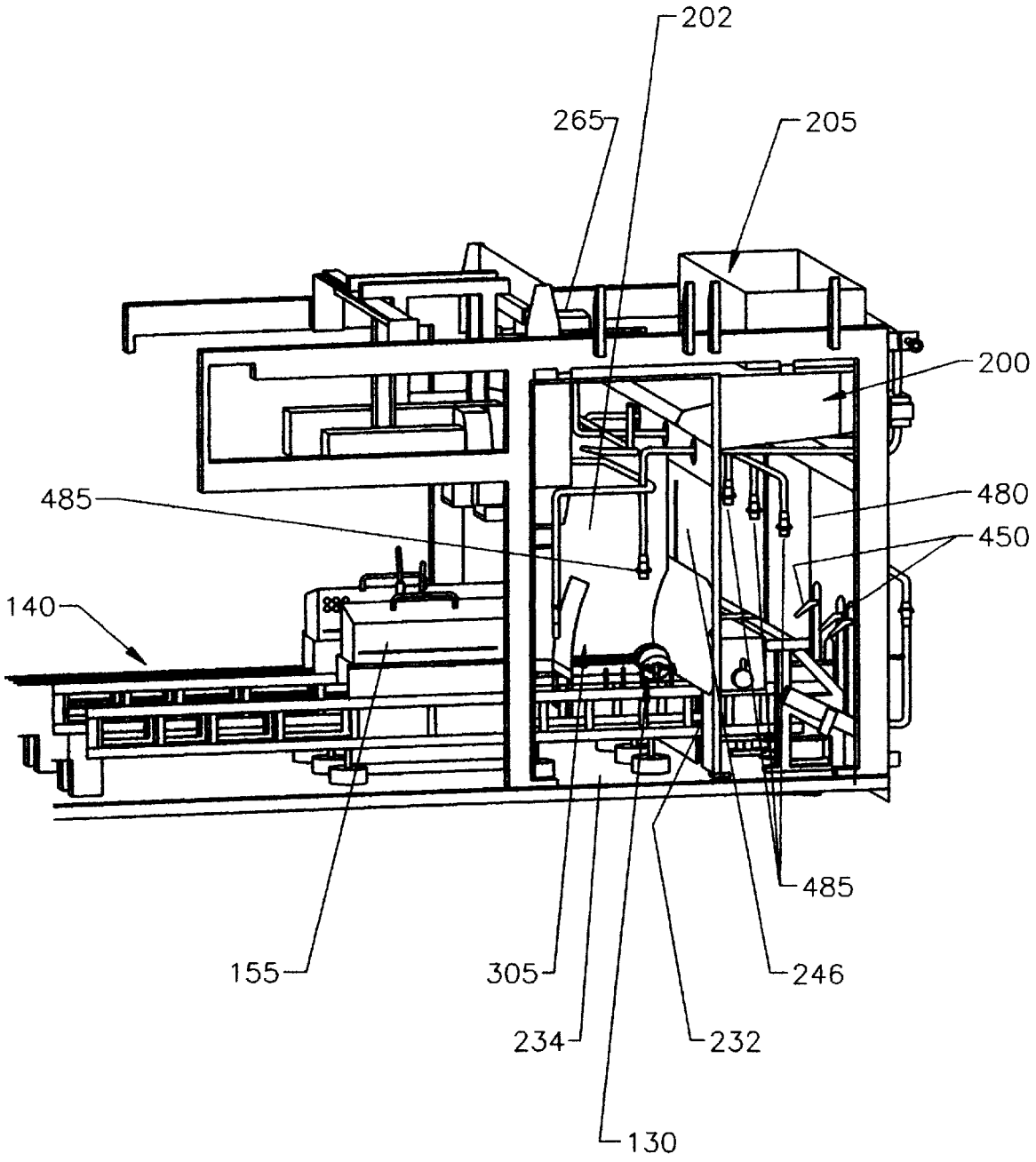
FIG. 4 is another perspective view of an embodiment of a filling machine with components removed illustrating the orientation of corresponding ductwork to operate with an embodiment of the microfiltrated clean air supply system.

FIG. 3 is a perspective view of the filling machine 100 with certain components removed (such as the doors 180, etc.) to more clearly illustrate an embodiment of a compartmentalized clean air system arranged therein. Such a system is disclosed in a patent application entitled "Filling Machine Having a Compartmentalized Clean Air System Enclosing The Filling System Thereof," U.S. patent application Ser. No. 08/828,329. FIG. 4 is another perspective view similar to that of FIG. 3.

The compartmentalized clean air system is referenced generally at 200 and effectively encloses the fill station 125 within a positively pressurized chamber 202 having a downward flow of clean or Class 100 air. Those familiar with aseptic packaging requirements will understand that class 100 or better air is needed to meet standards. For example, when sterile product is packaged in a sterile container in an environment of class 100 clean air the product is considered to be a sterile packaged product.

As will be evident from the following description, the downward flow of clean air is particularly directed about the fill pipe of the filling station so that the filling process is performed in a very hygienic atmosphere. Preferably, at least the top folding portion of the top sealing station is also enclosed in chamber 202.

As illustrated, the compartmentalized clean air system 200 includes an inlet aperture 205 that is part of an upper duct portion 210. The upper duct portion 210 is connected to or part of a roof portion 215 having a peak 220 in the center and sidewalls 222 that slope away from the peak 220 toward each lateral edge of the machine.

Inlet aperture 205 is connected to a source of class 100 or clean air as discussed above. The air preferably is microfiltered. With reference to FIGS. 1 and 2, this clean air source may be in the form of a microfiltrated air supply system 224 that is located atop the filling machine 100 over the roof portion 215. The air supply system 224 has a air outlet 225 that is connected in fluid communication with the inlet aperture 205. Upper duct portion 210 opens to chamber 202 and includes one or more structures that assist in providing a downward flow of filtered air through chamber 202.

In the illustrated embodiment, chamber 202 is defined by a pair of lateral walls that are comprised of glass doors 180 (see FIG. 1 and FIG. 2) and by a pair of transverse walls comprising an entrance wall 226 and an exit wall 230. The entrance wall 226 is substantially vertical and is arranged at the entrance of the chamber 202 enclosing the fill station 125. Entrance wall 226 includes at least one carton aperture 227 through which the cartons are conveyed by conveyor 140 into chamber 202. The exit wall 230 is also substantially vertical and is arranged at a distance from the entrance wall 226. Similarly, the exit wall 230 is provided with an outlet aperture 232 through which the cartons are conveyed by conveyor 140 to exit the chamber 202. The chamber 202 is defined at the upper portion thereof by the roof 215 and at the lower portion thereof by table 234. Thus, the entrance wall 226, the exit wall 230, the side glass doors 180, the table 234, and the roof 215 enclose and define the interior chamber 202. A fill pipe 240 of the filling station 125 is preferably the only component of the fill pump mechanism located in the chamber 202. The top folding portion of the top sealing station is located in the chamber 202. However, it is advantageous to include the ultrasonic top sealer within the chamber 202 as well. In cases in which the machine 100 is a dual-line machine, a divider wall 305 may be used to separate the fill lines within the chamber 202.

Figure 5:
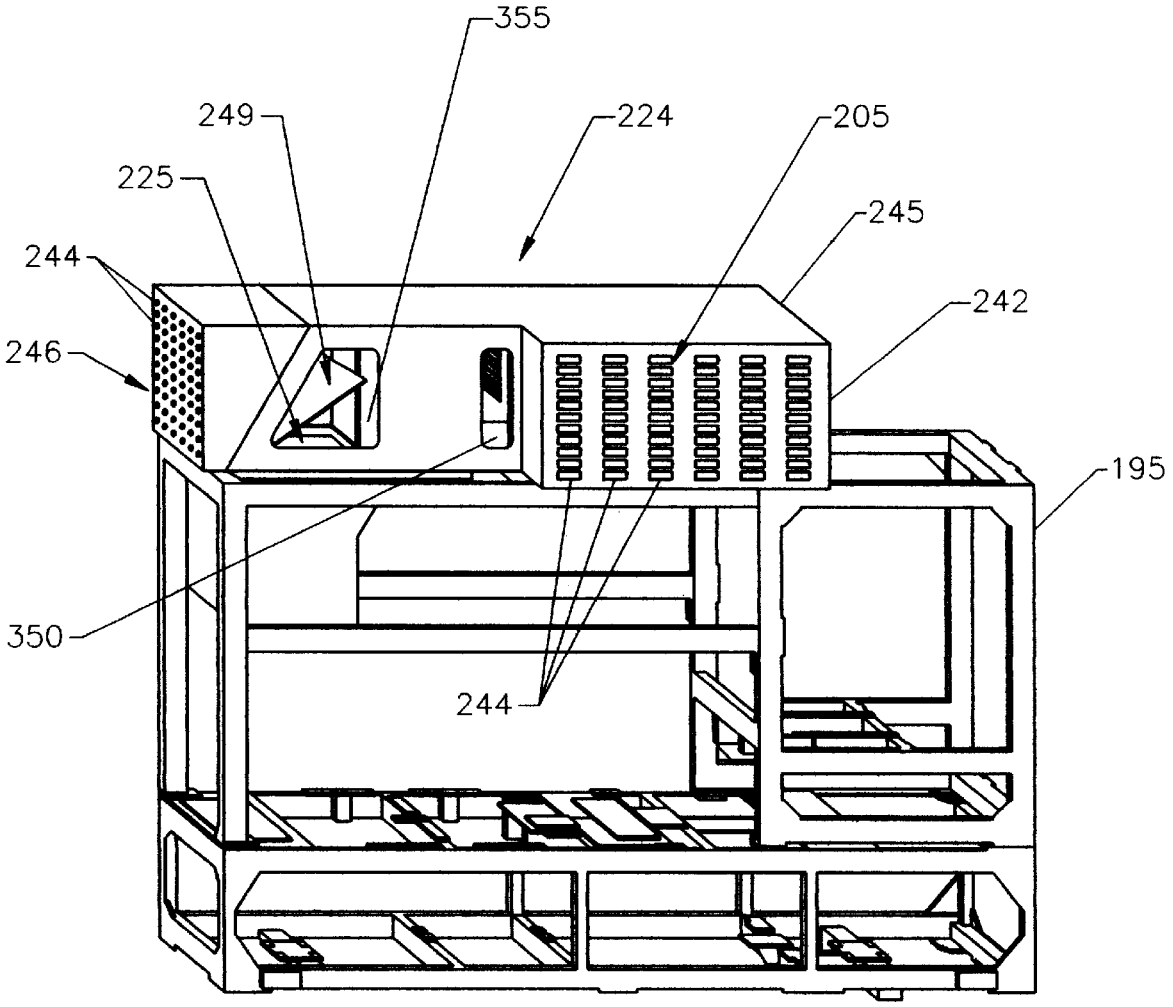
FIG. 5 is a perspective view of the embodiment of the framework of a filling machine of illustrating the orientation of an embodiment of the microfiltrated clean air supply system relative to the machine.

Referring to FIG. 5, the microfiltrated clean air supply system is referenced generally at 224 and includes the inlet 205 and the outlet 225. The inlet 205 is covered by an inlet door 242. The inlet door 242 preferably has a plurality of louvers 244 formed therein to allow the intake of air into the clean air supply system 224.

Figure 6:
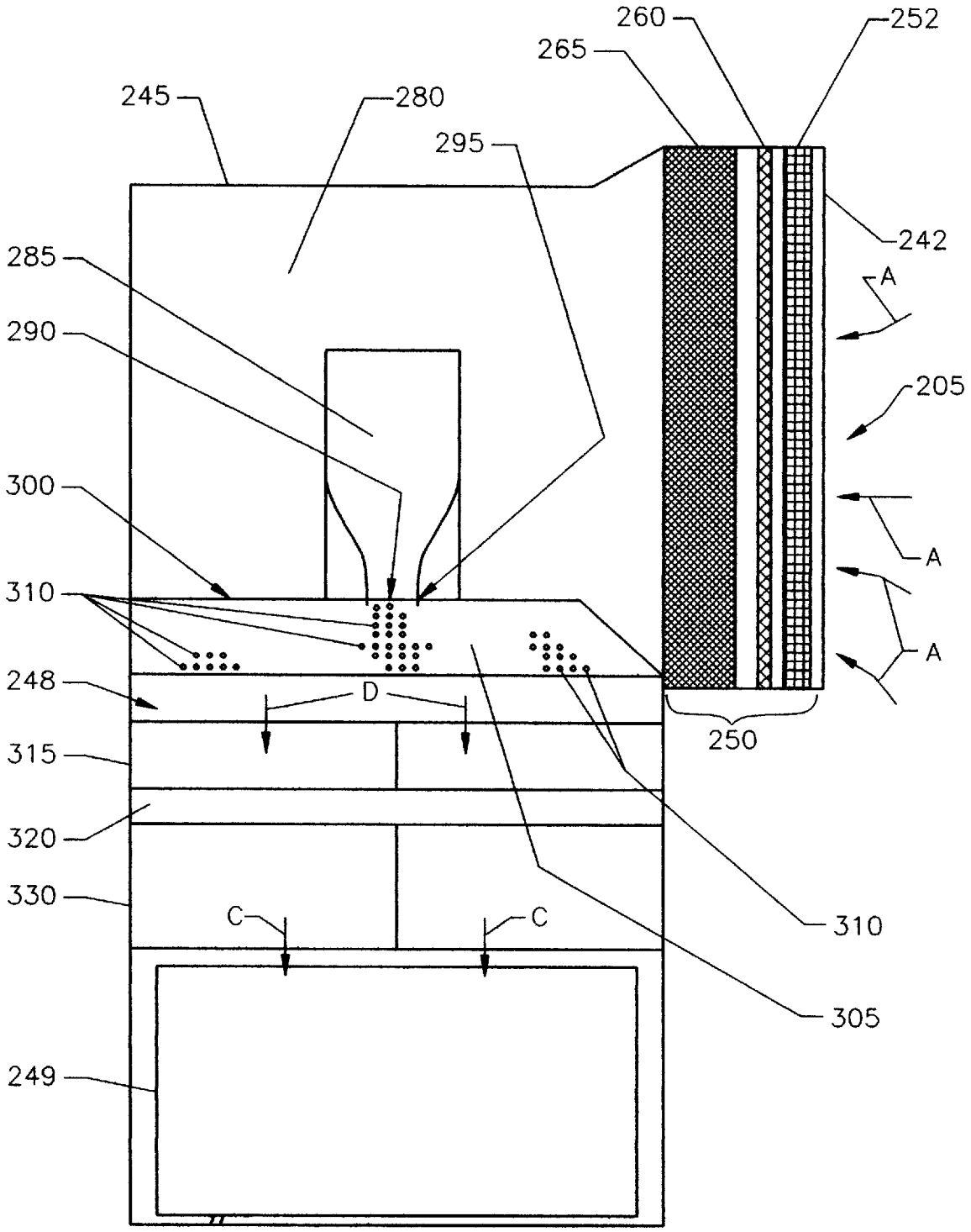
FIG. 6 is a top schematic view of an embodiment of the microfiltrated clean air supply system.
Figure 7:
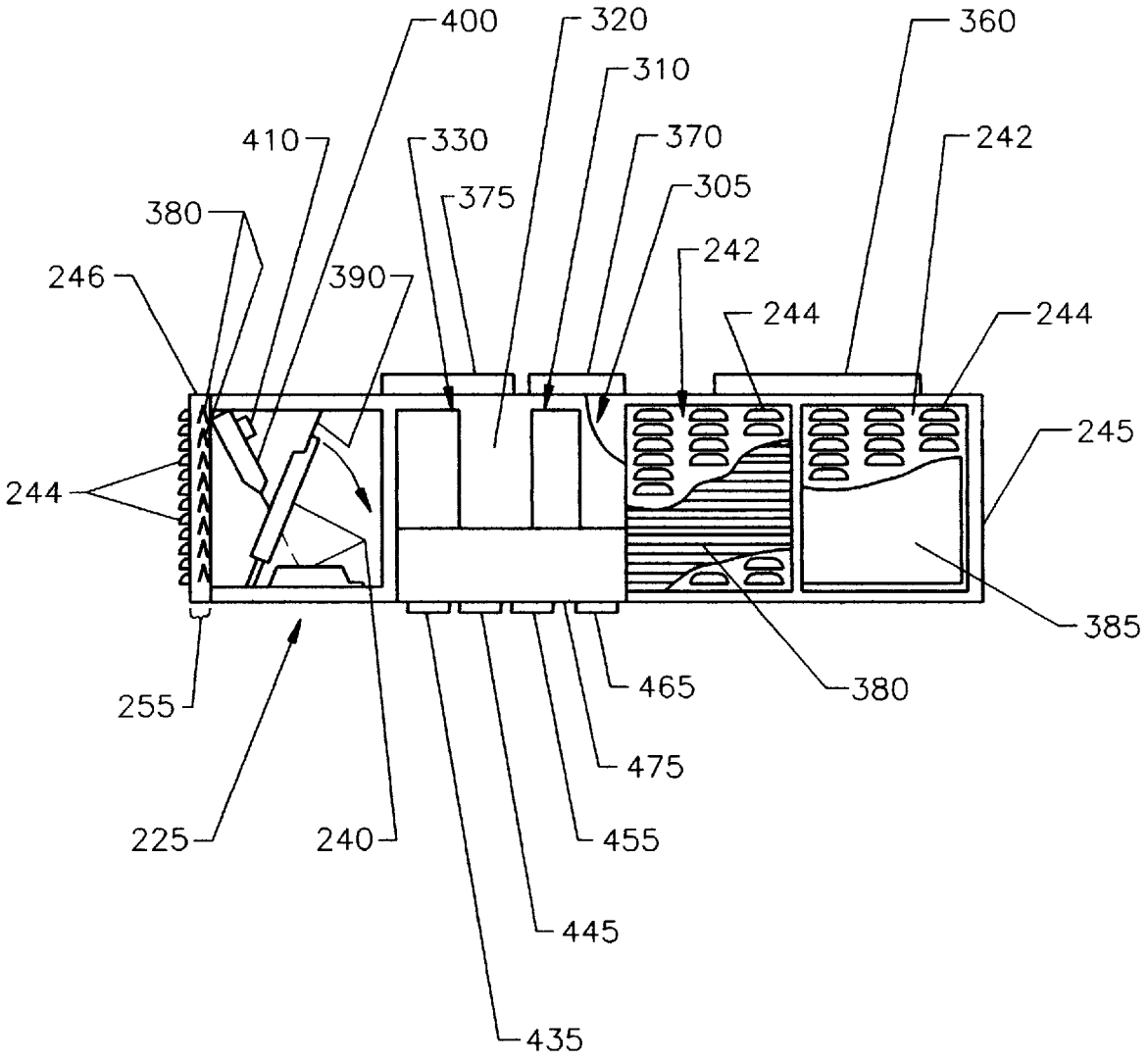
FIG. 7 is a side view in partial cross-section, illustrating various components of an embodiment of the microfiltrated clean air supply system.

The clean air supply system 224 comprises a housing 245. The housing module 245 is preferable brushed or polished stainless steel 304 with the seams being minimized. The housing 245 extends from the inlet 205 to the outlet 225. An outlet door 246 is arranged near the outlet 225 and has louvers 244 like those formed in the inlet door 242. Thus, the housing 245, the outlet door 246 and the inlet door 242 enclose and define an interior chamber 248. The interior chamber 248 of the housing 245 is described further below with reference to FIG. 6. An adjustable damper mechanism 249 is also illustrated in FIGS. 5, 6 and 7. The arrangement and operation of the damper mechanism 249 is discussed below with reference to FIG. 7.

FIG. 6 illustrates a schematic layout of an embodiment of the microfiltrated air supply system 224. The system 224 includes the louvered inlet doors 242 covering the inlet 205. The louvered inlet doors 242 include an external aesthetic portion with a set of internal V-shaped louvers, the combination of which provides an impenetrable path for any directed liquid spray from entering the inlet doors 242. A first plurality of filters 250 arranged transverse to the incoming air flow indicated by arrows referenced A is provided in the inlet 205 of the clean air supply system 224. Coalescing filters 252 are preferably mounted in the inlet door 242. The combination of the coalescing filters 252 and louvers 244 with a labyrinth-style sealing arrangement 255 (discussed below with reference to FIG. 7) on the inlet doors 242 collects condensed water vapor before the moisture inhibits and potentially weakens downstream filters. The coalescing filters 252 protect the clean air supply system 224 in moist or wet environments.

In a preferred embodiment, the first plurality of filters 250 includes a first ASHRAE prefilter 260 having a collection efficiency within an approximate range of 30%–60%. A second ASHRAE prefilter 265 having a collection efficiency within an approximate rang,e of 90–95% is also arranged downstream with respect to the first ASHRAE prefilter 260 in the inlet 205 of the housing 245. A framework of the 95% ASHRAE filter 265 may be sealed against the housing with a foam gasket. The combination of the two levels of ASHRAE prefilters 260, 265 collects most of the mold and yeast before it ever reaches the final filters. The final filters are discussed below.

Additionally, the ASHRAE prefilters 260, 265 include an antimicrobial agent to prevent mold growth on the filter media. The antimicrobial agent may be impregnated into the filter 260, 265. The ASHRAE filters 260, 265 may be treated with an antimicrobial spray or incorporate a BioStat weave. For example, in a preferred embodiment, an Aegis Antimicrobial system is sold as a complement to the 30% ASHRAE filter 260 manufactured by Tri-Dim Filters of Elgin, Ill. Also, in a preferred embodiment, an Antimicrobial Treatment is sold as a complement to the 95% ASHRAE filter 265 manufactured by Flander's Filters of Washington, N.C. Consequently, the collected mold is inhibited and then disposed of by periodic replacement of the ASHRAE prefilters 260, 265 which extends the life of the final filters by protecting them from potential "mold row-through."

A blower chamber 280 is also provided within the housing 245 of the microfiltrated clean air supply system 224. A blower 285 is preferably mounted in the blower chamber 280 in a known shock absorbing manner to reduce vibrations. Preferably, the blower 285 is a direct drive, high-output type capable of producing 2,000 cfm±20% over the required range of static pressure.

It is preferred that the blower 285 run continuously; however, during cleaning operations and off-production time, the blower 285 may be operated at a lower speed to minimize energy expenditures and maximize filter life. To this end, the blower 285 may be adjustable, with two step settings. Also, the blower 285 should not be included in an emergency stop for the filling machine 100, since continuous operation is desired. The preferred blower 285 also has overload protection and resistance to cleaning chemical vapors. Also, an efficient and long running blower requiring minimal lubrication and maintenance is preferred.

Further, blower 285 includes an exhaust port 290 connected in fluid communication with an aperture 295 in a dividing wall 300. The air through the blower 285, which has been prefiltered by the coalescing filters 252 and first and second ASHRAE prefilters 260, 265, exits the exhaust port 290 and impinges upon a diffuser plate 305 as shown in FIGS. 6 and 7. The diffuser plate 305 is arranged in front of the blower 285 to distribute the air. The diffuser 305 is preferably perforated metal, for example, 16 gauge stainless steel 304, formed to a preselected shape and appropriately arranged in the housing 245. FIG. 6 illustrates a portion of a plurality of perforations 310 formed in the diffuser 305. The perforations 310 comprise approximately 0.25 inch holes arranged on 0.375 inch center stagger spacings to provide approximately 40% porosity.

As shown in FIG. 6, diffused air indicated by arrows referenced D flows through a second plurality of filters, including 95% collection efficiency DOP prefilters 315. The 95% DOP prefilters 315 have a collection efficiency of 95% for 0.3 $\mu$m diameter particles. Also, the 95% DOP prefilters 315 may be secured within the housing 245 by known sealing means familiar to those skilled in the art. For example, the 95% DOP filters 315 are sealed with foam in a gasket seal in a stainless steel 304 frame. The 95% ASHRAE prefilters 265 are also sealed with foam. The prefilters 260, 265, 315 preferably are constructed of a hydrophobic material, for example, a fiberglass media.

An air gap 320 is illustrated between the 95% DOP prefilters 315 and final filters 330. Final filters 330 are preferably held by a known gel/knife-type seal to provide airtight seal of the final filters 330 within the housing 245. The final filters 330 preferably have a collection efficiency of at least 99.99999% for 0.12 $\mu$m diameter particles. Pleats in the final filter 330 are mounted in a vertical orientation.

In a specific embodiment, the preferred filters have the following listed sizes and collection efficiencies, and are available from known suppliers. The preferred filters include: coalescing prefilters 252 (24"×24"×2") manufactured by AAF Snyder General Corp., Louisville, Ky.; 50% ASHRAE rigid pleat prefilter 260 (24"×24"×2") manufactured by TRI-DIM, Elgin, Ill.; 95% ASHRAE Econocell 11 prefilters 265 (24"×24"×5.875") manufactured by FFI Flander Filters, Washington, NC; 95% DOP Pureform Separatorless filter 315 (24"×24"×5.875") (95% at 0.3 $\mu$m) manufactured by FFI; and final filters 330 VLSI II Pureform Separatorless filters (24"×24"×11.5") (99.99999% at 0.12 $\mu$m) manufactured by FFI, or if unavailable, an ULPA filter having a specified collection efficiency of greater than or equal to 99.9995% at 0.12 $\mu$m particle diameter.

The microfiltrated clean air, indicated by arrows referenced C, flows through the final filters 330 and impinges upon the bypass damper 249 as illustrated in FIGS. 5 and 7 and as further described below before passing into the duct work in fluid communication with the sterile chamber 180 of the compartmentalized clean air system 175 mentioned above.

To this end, the aforementioned embodiment of the microfiltrated clean air supply system 224 provides a level of filtration to yield a supply of high quality air even in challenging (dirty) environments. For example, the air quality of air entering the filling machine can be estimated from the following ambient air concentrations. Assuming an input ambient concentration of $1\times10^6$–$5\times10^8$ particles/ft$^3$ (of particles >0.3 $\mu$m) results in an output from the clean air module of 0.005–2.5 particles/ft$^3$ for particles greater than or equal to 0.3 $\mu$m in aerodynamic diameter. The expected output concentration is at least 100 times more favorable than the 300 particles/ft$^3$ of >0.3 $\mu$m particles mandated by a Class 100 environment (as defined in FED-STD-209E).

Referring back to FIG. 5, the housing 245 is constructed and arranged to provide an operator with visual and physical access to the internal components of the microfiltrated clean air supply system 224 contained within the housing 245. To this end, a transparent view port 350 for the blower 285 is provided. Additional view ports are provided as needed. In particular, a further view port 355 for allowing visual inspection of the final filter 330 and the bypass damper 249 is formed in the housing 245 as shown in FIG. 5.

Physical access to the internal components of the clean air supply system 224 is also preferably provided. An embodiment illustrating various components of the microfiltrated clean air supply system 224 is shown in FIG. 7 in partial cross-section. For example, the coalescing filters 252 and the ASHRAE prefilters 260, 265 are accessible from the side via the inlet doors 242. Access to the blower 285 can be gained from the inlet doors 242 and a removable top panel 360 covering an aperture in the top of the housing 245. The 95% DOP prefilters 315 can be serviced via a second top access panel 370. The final filters 330 are similarly accessible via a third top access panel 375. Thus, the housing module 245 provides operator access to the internal components while still protecting the filters from harsh external environments, overhead drainage and dripping condensate, as well as product splashes and physical damage.

FIG. 7 illustrates an additional arrangement for preventing even a direct external spray of liquid from entering either the inlet doors 242 or the outlet door 246. In particular, the louvers 244 in the doors 242, 246 form a labyrinth-type seal when combined with a plurality of inverted V-shaped deflectors 380 arranged inside the doors 242, 246. The cooperative arrangement of the louvers 244 and the deflectors 380 inside the doors 242, 246 creates an obstructive path to prevent a direct spray of water, cleaning solution or any liquid from entering the housing 245 via the doors 242, 246. In addition, a screen mesh 385 is located adjacent the louvers 244 to prevent insects or small debris or particles from entering.

FIG. 7 also illustrates the bypass damper mechanism 249 incorporated in the housing module 245. The damper 249 preferably has two positions. Both alternatives are illustrated in FIG. 7. In a first open position used during normal operation of the filling machine 100, the bypass damper 249 is preferably arranged at approximately a 60° angle along an angled surface 390. When in this open position, the damper 249 deflects the filtered air indicated by arrows C in FIG. 6 downward into the sterile chamber 180 of the filling machine 100.

The damper 249 also has a second, closed position that can be selected to isolate the sensitive filters during the cleaning operation of the filling machine 100 or during downtime. When this second, closed position is selected, the damper 249 is in a horizontal position sealing the outlet 225 as shown in FIG. 7. The damper 249 protects the filters of the microfiltrated air supply system 224 by effectively sealing the outlet 225 and deflecting cleaning solution back down into the filling machine 100.

To select between the two damper positions, the bypass damper 249 is provided with an actuator, for example, a pneumatically-actuated control arm 400. The position of the damper 249 can thereby be selected for simultaneous cleaning bypass control and filter protection or normal operation. As illustrated, the damper 249 and actuator 400 are internally mounted in the housing 245. However, the actuator 400 may be externally mounted. A sensor 410 is also provided to detect or validate the position of the damper 249. Also, the location of the damper 249 may be visually determined via the further view port 355 (see FIG. 1). The bypass damper 249 facilitates the automated cleaning of the filling machine 100. The pneumatically actuated damper 249 closes during cleaning cycles thereby protecting the final filters 330 from the spray of cleaning solution discussed below.

FIG. 7 also illustrates a plurality of pressure gauges for monitoring the operation of the filters by detecting pressure changes across the filters. The opening of the filter doors may be detected by the pressure gauges. The plurality of pressure gauges include a first gauge 435 (see FIG. 7) connected to provide a visual indication to the operator of the pressure in the sterile chamber 180. Adjustable maximum and minimum alarm levels are incorporated into the gauges which interface with a programmable logic controller (PLC) 440 in the control cabinet 105 (see FIG. 2) of the machine 100 to inform the machine when the acceptable levels have been breached.

A second gauge/sensor for detecting a change in pressure across the 99.99999% PSL final filter 330 is also provided. Pressure ports provide the input to gauges. Similarly, a corresponding second gauge 445 is connected to the to display the change in pressure across the 99.99999% PSL (330) 315. Likewise, a third gauge 455 is connected to display the change in pressure across the 95% DOP Prefilter 315. In addition, a corresponding fourth gauge 465 is provided for detecting and displaying a change in pressure across the 95% ASHRAE prefilter 265 (see FIG. 6).

The displayed pressure readings can enable the operator to monitor performance of the internal components in the housing 245. For example, a change of pressure across the prefilters may indicate a filter change is needed, a major leak or a lack of a filter. Also, a change of pressure across the final filter 330 can indicate similar problems. In addition, the insertion of a filter of inferior quality, for example, a HEPA filter instead of a VLSI II filter as specified in the preferred embodiment above may be indicated by the second gauge 445. In addition, varying degrees of alarms for each filter can be included. As shown in FIG. 7, the gauges 435, 445, 455, 465 are mounted on an exterior panel 475 at an angle that is easily visible to the operator.

As set forth above, a benefit of the embodiment of the microfiltrated clean air supply system 224 described above is the fact that it allows automatic cleaning methods and equipment to be used to clean and sterilize the stations in the filling machine 100. For example, referring back to FIG. 1, an automatic cleaning system referenced generally at 480 is provided within the filling machine 100. The cleaning system 480 includes a plurality of spray balls 485. During a cleaning operation, the spray balls 485 comprehensively spray the stations, and in particular, the filling station 125 and the sealing station 130, with a cleaning solution.

The microfiltrated clean air supply system 224 of the present invention is arranged such that the components thereof do not interfere with the automatic cleaning system 480. As shown, the clean air supply system 224 is mounted wholly atop the filling machine 100. Further, as explained above, to isolate the sensitive filters during a cleaning operation or during downtime the second, closed position is selected so that the damper 249 is in a horizontal position sealing the outlet 225 as shown in FIG. 7. The damper 249 protects the filters of the microfiltrated air supply system 224 by effectively sealing the outlet 225 and deflecting cleaning solution back down into the filling machine 100.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. A form, fill and seal packaging machine for processing a series of cartons conveyed along a predetermined path, the packaging machine comprising:

a fill station for filling each carton with a product, the fill station substantially enclosed within a high hygiene chamber, the high hygiene chamber in flow communication with a microfiltrated air supply for positive pressurization of the chamber; and a microfiltrated air supply system in flow communication with the high hygiene chamber, the microfiltrated air supply system comprising a housing having an inlet for receiving air from the environment, an outlet in flow communication with the high hygiene chamber and a blower chamber disposed between the inlet and the outlet, a first plurality of filters for filtrating air from the inlet, the first plurality of filters arranged in order of increasing collection efficiency within the housing adjacent the inlet, the first plurality of filters including a coalescing filter, a first prefilter having a collection efficiency of approximately 30%–60% and a second prefilter having a collection efficiency of approximately 95%, a blower disposed in the blower chamber for directing filtered air from the first plurality of filters through the blower chamber and to a diff-user plate for distribution, a second plurality of filters for receiving air from the diffuser plate, the second plurality of filters arranged in order of increasing collection efficiency within the housing near the outlet, the second plurality of filters including a prefilter having a collection efficiency for particles having a diameter of 0.3 microns and larger of approximately 95% and a final filter having a collection efficiency for particles having a diameter of 0.12 microns and larger of at least approximately 99.99999%, and a damper for receiving microfiltrated air from the second plurality of filters and directing the microfiltered air to the outlet, the damper operable in an open position and a closed position.

* * * * *